US005626610A

United States Patent [19]

Janke

[11] Patent Number: 5,626,610

[45] Date of Patent: May 6, 1997

[54] DRAW CLAMP

[76] Inventor: Richard C. Janke, N7560 Bell School Rd., Burlington, Wis. 53105

[21] Appl. No.: 540,565

[22] Filed: Oct. 6, 1995

[51] Int. Cl.[6] ..... A61B 17/08

[52] U.S. Cl. ..... 606/212; 606/213

[58] Field of Search ..... 606/212, 215, 606/216, 218, 213

[56] References Cited

U.S. PATENT DOCUMENTS 376,441 1/1888 Hughes ..... 606/218
380,093 3/1888 Cruice et al. ..... 606/212
3,118,449 1/1964 Bane ..... 606/212

*Primary Examiner*—Michael Buiz
*Assistant Examiner*—Tina T. D. Pham
*Attorney, Agent, or Firm*—Wheeler Kromholz & Manion

[57] ABSTRACT

A reusable draw clamp which brings together the opposed surface of a hoof Quarter Crack to promote healing of the crack. The draw clamp includes two plates, a threaded bolt, and a nut. Each plate has a plurality of holes which permit the plate to be fastened with screws to a respective side of a Quarter Crack. One plate receives a threaded bolt and the opposite plate supports a nut. Threading engagement of the bolt and nut permit the space between the plates to be adjustably drawn together to close the Quarter Crack.

5 Claims, 1 Drawing Sheet

DRAW CLAMP

BACKGROUND OF THE INVENTION

The present invention relates generally to the repair of animal, and in particular, horse hoofs. More particularly, this invention relates to the reduction of injury and repair of Quarter Cracks that occur in animal hoofs.

Quarter Cracks often occur in the hoofs of animals which have been exposed to repetitive or particularly strenuous contact with a hard walking surface. These cracks begin to form at the top of the hoof near the hair line and expand downwardly toward the bottom of the hoof. The majority of Quarter Cracks (90–95%) occur on the side of the hoof while 5–10% occur on the front portion of the hoof.

Quarter Cracks significantly impair the function of the animal's hoof. Small Quarter Cracks create substantial discomfort for the affected animal and can reduce its mobility. Large Quarter Cracks can cause the animal to become maim.

Quarter Cracks can heal themselves, unaided, if the animal remains immobile for a significant period of time or patches can be applied to assist the healing process. Both of these methods involve reduced mobility of the animal and glued patches often require the hoof to be prepared by filing and sanding. In addition, glued patches or fasteners often require reapplication, and are susceptible to deterioration and reduced function if used on the hoof of an animal that continues to walk. The present adjustable clamp has the ability to tightly and permanently draw together a Quarter Crack, allowing it to heal while also allowing the animal full mobility without further damaging the hoof.

SUMMARY OF THE INVENTION

Accordingly, it is an object of the present invention to provide a clamp used for drawing together a Quarter Crack occurring on a hoof to prevent the crack from increasing in length or depth and to promote healing while allowing use of the hoof as it heals.

It is also an object of the present invention to provide such a clamp that is reusable and suitable for use with a variety of animal hoofs.

It is a further object of the present invention to provide such a clamp that may be used in a variety of locations on a hoof.

It is another object of the present invention to provide a hoof clamp which permits adjustment of the tension and secured position to the most beneficial status for promoting healing based on the magnitude and needs for repairing a variety of cracks.

The present clamp comprises two substantially identical plates adjoined by a threaded bolt and nut. Each of the respective plates includes a number of apertures through which screws can be inserted for securing the respective plate to an animal's hoof. Each plate is comprised of a flat stamping which is relatively flexible to conform to the hoof surface, as will later be explained. The stamping includes an end portion which is substantially normal to the remaining surface portion of each of the plates. That is, the upstanding end portion is formed by a reverse bend located intermediate of the ends of the respective plates to provide a surface for receiving a nut and a bolt combination for use in drawing the respective plates towards one another after they have been secured to the respective sides of the Quarter Crack. A detailed description of the operating components will follow. It will be observed however that when the secured sides are fastened to opposite surfaces of the Quarter Crack, and are thereafter tightened and drawn together the sides of the Quarter Crack will be drawn toward closure and also to prevent enlargement of the crack while promoting healing of the affected crack. The invention also provides for the clamp components to later be removed from the healed hoof and, for the most part, may be reused.

Also, as stated previously, the clamp plates may be slightly flexible and fabricated from stainless steel which can be manipulated to conform to the curvature of a respective hoof.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
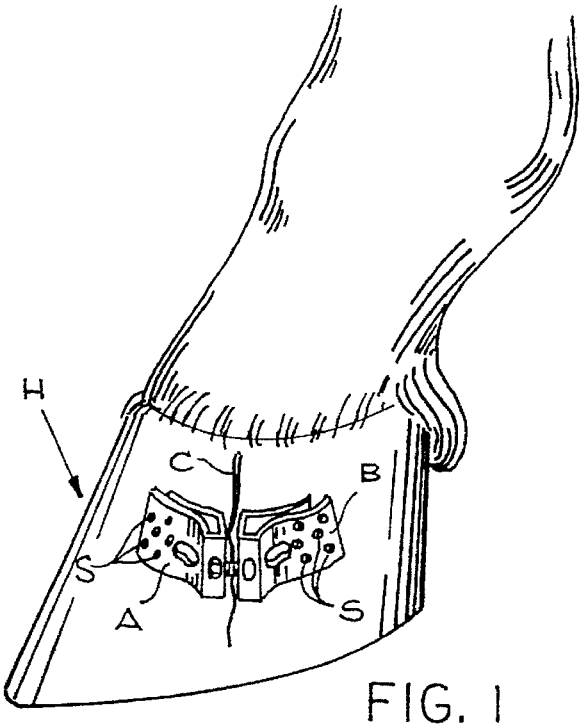
FIG. 1 is a perspective view of the clamp of this invention, showing a fix to a Quarter Crack at the side of an animal's hoof.

With reference to FIG. 1, it will be noted that the draw clamp of this invention comprises substantially identical, preformed stampings A and B located at respective sides of a Quarter Crack C which has occurred at an animal's hoof H. After securing the plates A and B by means of a preselected number of screws S, the plates A and B may be drawn toward one another to close the Quarter Crack C by means of the threading engagement of a nut and bolt combination shown in greater detail in FIG. 3.

Figure 2:
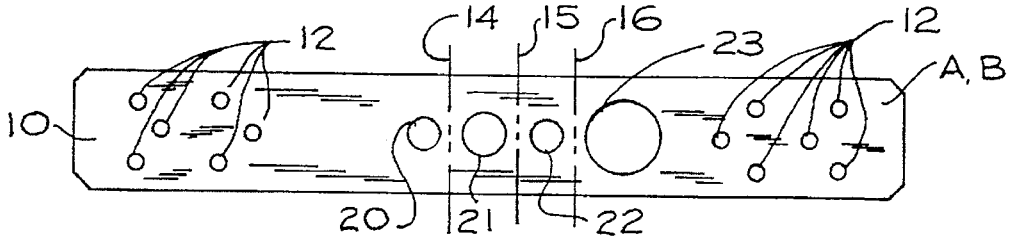
FIG. 2 is a top plan view of a flat stamping of stainless steel shown prior to being formed into the desired configuration.

Next, with reference to FIG. 2, it would be noted that each of the plates A, B have a substantially identical configuration and be made from a stainless steel stamping 10. As stated previously, the stamping 10 is preferably formed of a somewhat flexible thickness in material to permit ready conformity to various sized and shaped hoofs.

The stamping 10 includes a plurality of openings or apertures 12 which are located for alignment with one another after forming the respective plates to the configuration end of FIG. 3, as will later be described. FIG. 2 also illustrates three fold lines 14, 15, and 16 illustrated in phantom on the view of FIG. 2. Each plate is also preferably provided with additional openings 20, 21, 22, and 23, of various sizes the purposes of which will be described in connection with the view of FIG. 3.

Figure 3:
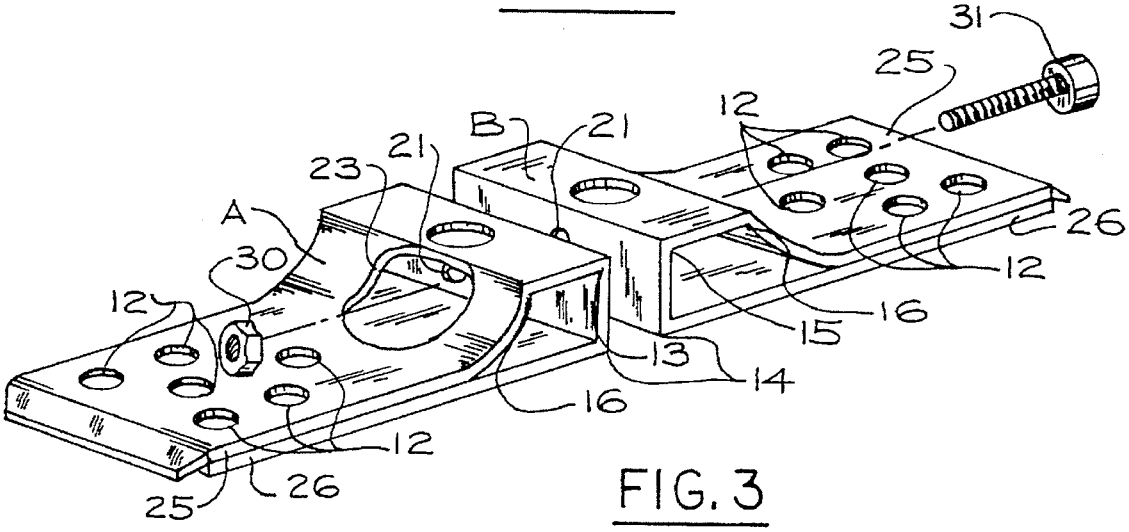
FIG. 3 is an exploded view of adjoining clamping plates of this invention and their relationship to a nut and bolt clamping means.

As shown in the exploded view of FIG. 3, each plate A and B is provided with a reverse bend located intermediate the ends of the respective stampings. The bend is form to be folded backwardly at the phantom line positions 14, 15 and 16 corresponding to the same phantom lines shown in FIG. 2. The formation is such as to provide laminates 25 and 26 with each of the respective openings or apertures 12 being held or formed in registered alignment with one another for later receiving the screws S (see FIG. 1). The opening 23 (shown specifically in the view of plate A of FIG. 3) is enlarged to receive either the nut 30 or the threadingly engageable bolt 31. The shaft of the bolt 31 is arrange to be received through the respective openings 21 for engagement with the nut 30.

As discussed previously, the plurality of apertures 12 are provided for receiving the threaded portion of screws S passed therethrough for fastening the respective plates A, B to the hoof H. It is not required that a screw S be inserted through every apertures 12, although utilizing three or more is recommended. The very locations of the apertures 12 are well suited to provide several combinations for securing the plate to regions of the hoof H that are best suited to accommodate a secure and safe anchorage to the hoof H. It will thus be apparent that, a fissure or Quarter Crack occurring in a hoof may be prepared for receiving the draw clamp plates A and B by being reasonably washed with appropriate materials to disinfect and free the Crack of excess debris. After removing any unnecessary pressure to the hoof H, the clamp plates A, B are positioned such that each plate is located on opposite sides of the Quarter Crack approximately at the midpoint between the beginning of the Crack and the end of the Crack. Based upon the shape and condition of the hoof H around the Crack C, self-tapping screws S of appropriate length are inserted through preselected hole 12 locations to be fastened to the hoof H. The screws S are reasonably tightened such that each of the screws S and plates A, B will be secured while not exceeding the force that the hoof is capable of holding without stripping. As an alternative, the area of the hoof H into which the screws are to be inserted my be pre-drilled to an appropriate depth for receiving screws S. After the plates A, B are fastened to the hoof H, the bolt 31 is threaded into the nut 30 and the nut and bolt members are drawn together for locating the secured plates at a reasonable position and pressure for closure of the specific Crack.

The draw clamp plates A, B are left on the hoof for a period of time, such that the Quarter Crack completes its healing. After the pressure between the two plates is removed by unthreading the bolt and nut, it may be possible, if desired, to reuse the components should another Quarter Crack develop at a later date.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A draw clamp apparatus for repair of a hoofed animal Quarter Crack, the apparatus comprising plate members arranged for securement to hoof portions located at opposite sides of an affected Crack, and with each plate member being provided with cooperating elements for bridging said Crack and arranged to draw the respective plates toward one another for closure of said Crack;

the respective plate members being of substantially identical configuration, and each being formed from a stamping of relatively thin metallic stock;

the respective plate members being formed intermediate their ends to provide an upstanding surface defining an opening for receiving a respective threaded nut and mating bolt elements for drawing said plates toward one another to close said Quarter Crack;

the respective plate members each having a plurality of apertures proximate to opposite end portions of said stamping, and wherein the plate members are further formed with a reverse bend intermediate respective plate member ends with said apertures of each adjacent plate end being located in registered alignment for receiving screw fasteners for securing the respective plate members to the animal hoof.

2. The draw clamp of claim 1, wherein said upstanding surface opening forms an enclosed section for receiving said respective threaded nut and mating bolt elements.

3. The draw clamp of claim 2, wherein the enclosed section of each of said plate members includes an enlarged aperture through which the exterior surfaces of said nut and bolt elements may be operated for securement relative to one another and for drawing said plate members toward one another.

4. A draw clamp apparatus for repair of a hoofed animal Quarter Crack, the apparatus comprising plate members arranged for securement to hoof portions located at opposite sides of an affected Crack, and with each plate member being provided with cooperating elements bridging the said Crack and arranged to draw the respective plates toward one another for closure of said Crack;

the respective plate members being doubled over by means a reverse bend, thus forming a double thickness and providing an upstanding surface defining an enclosure for receiving a respective threaded nut and bolt element for drawing said plates toward one another to dose said Quarter Crack;

the respective plate members having a plurality of apertures proximate to one end of each plate for receiving screw fasteners for securing the respective plates to the animal hoof.

5. A draw clamp apparatus for repair of a hoofed animal Quarter Crack, the apparatus comprising:

a pair of plate members arranged for securement to hoof portions located at opposite sides of an affected Crack, and with each plate member having cooperating elements for bridging said Crack and arranged to draw the respective plates toward one another for closure of said Crack;

the adjoining respective plates being doubled over by means of a reverse bend, thus forming a double thickness and providing an upstanding surface at one end of each plate member creating an enclosure for receiving the cooperating elements; and each plate end opposite said enclosure having a plurality of apertures for receiving screw fastener for securing each plate to opposite sides of said Crack.

* * * * *